US006837836B2

(12) United States Patent
Huang

(10) Patent No.: US 6,837,836 B2
(45) Date of Patent: Jan. 4, 2005

(54) EXERCISE BALL DEVICE

(76) Inventor: Yang-Chin Huang, No. 2, Alley 492, Hai Tian Rd. Sec. 2, Tainan City (TW)

( * ) Notice: Subject to any disclaimer, the term of this patent is extended or adjusted under 35 U.S.C. 154(b) by 49 days.

(21) Appl. No.: 10/316,586

(22) Filed: Dec. 9, 2002

(65) Prior Publication Data

US 2004/0110613 A1 Jun. 10, 2004

(51) Int. Cl.[7] ..... A63B 21/02
(52) U.S. Cl. ..... 482/126; 482/122; 482/139
(58) Field of Search ..... 482/51, 77, 49, 482/55, 121, 122, 123, 125, 126, 130, 139, 82, 140; 601/132, 120; 472/135, 134, 129; 473/428; 446/153

(56) References Cited

U.S. PATENT DOCUMENTS

| | | | | | |
|---|---|---|---|---|---|
| 85,514 | A | * | 1/1869 | Cross | 482/82 |
| 148,489 | A | * | 3/1874 | Murphy | 482/82 |
| 512,483 | A | * | 1/1894 | Patterson | 482/82 |
| 932,780 | A | * | 8/1909 | Hero | 601/132 |
| 1,694,044 | A | * | 12/1928 | Thompson | 482/87 |
| 2,229,801 | A | * | 1/1941 | Dozier | 482/82 |
| 3,589,721 | A | * | 6/1971 | Cronauer | 482/125 |
| 3,652,085 | A | * | 3/1972 | Cole | 482/129 |
| 4,328,964 | A | * | 5/1982 | Walls | 482/129 |
| 5,230,682 | A | * | 7/1993 | Myers | 482/122 |
| 5,282,777 | A | * | 2/1994 | Myers | 482/122 |
| 5,810,700 | A | * | 9/1998 | Orcutt | 482/123 |
| 6,524,226 | B2 | * | 2/2003 | Kushner | 482/126 |
| 6,652,421 | B1 | * | 11/2003 | Chen | 482/49 |
| 2003/0224914 | A1 | * | 12/2003 | De Montesquiex | 482/148 |
| 2004/0005939 | A1 | * | 1/2004 | Bourguet | 473/447 |
| 2004/0038784 | A1 | * | 2/2004 | Huang | 482/121 |

* cited by examiner

*Primary Examiner*—Nicholas D. Lucchesi
*Assistant Examiner*—Victor Hwang

(57) ABSTRACT

An exercise ball device has a big ball having a hole, an elastic cable penetrating a hole of a big ball, two end hooks disposed on two ends of the elastic cable, and two small ball having retainer rings to receive one of the end hooks.

1 Claim, 4 Drawing Sheets

EXERCISE BALL DEVICE

BACKGROUND OF THE INVENTION

The present invention relates to an exercise ball device. More particularly, the present invention relates to an exercise ball device, which can be connected with various articles.

A conventional ball is used for a ball game only. A user cannot use the ball to exercise many portions of a human body in a ball game.

SUMMARY OF THE INVENTION

An object of the present invention is to provide an exercise ball device, which can be connected with various articles.

Another object of the present invention is to provide an exercise ball device, which can be used for exercising many portions of a human body.

Accordingly, an exercise ball device comprises a big ball having a hole, an elastic cable penetrating a hole of a big ball, two end hooks disposed on two ends of the elastic cable, and two small ball having retainer rings to receive one of the end hooks.

DETAILED DESCRIPTION OF THE INVENTION

Figure 1:
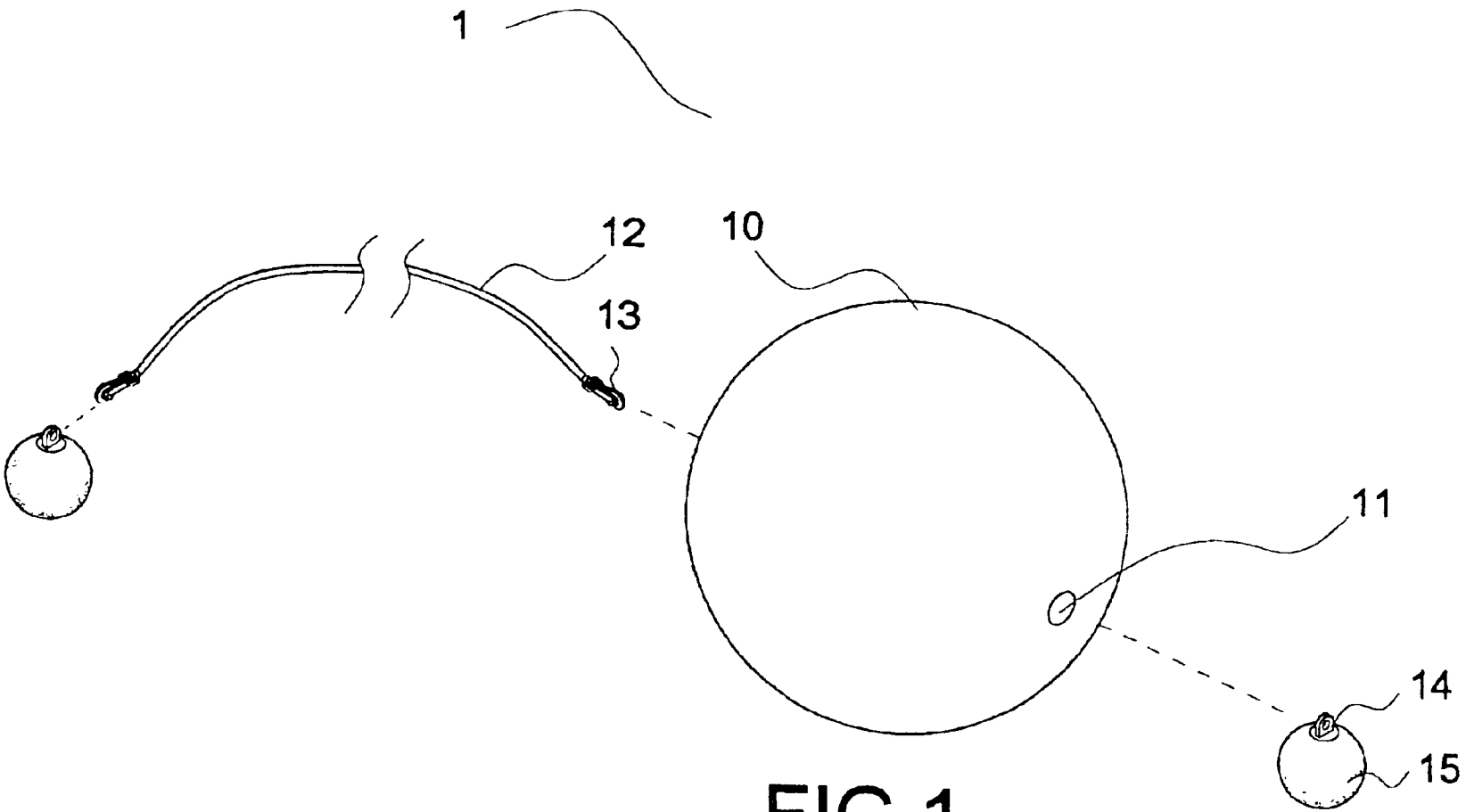
FIG. 1 is a perspective exploded view of exercise ball device of a first preferred embodiment in accordance with the present invention.
Figure 2:
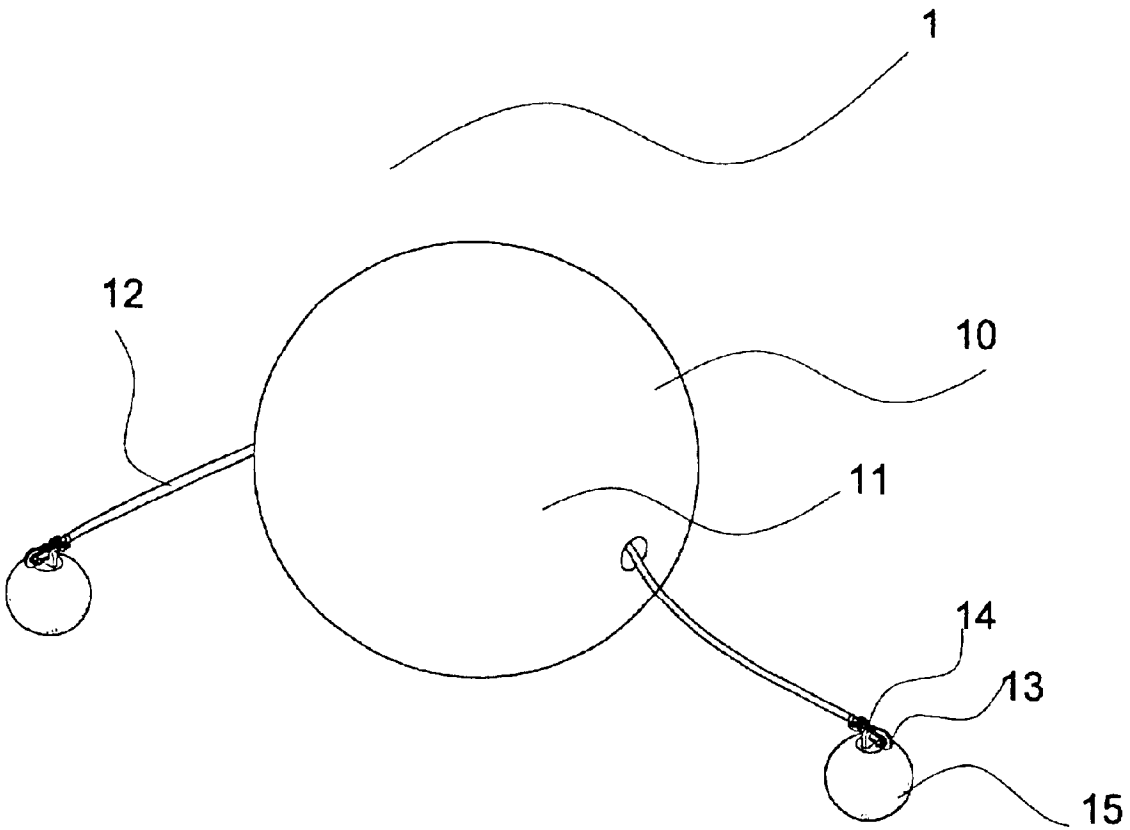
FIG. 2 is a perspective assembly view of an exercise ball device of a first preferred embodiment in accordance with the present invention.

Referring to FIGS. 1 to 2, an exercise ball device 1 comprises a big ball 10 having a hole 11, an elastic cable 12 penetrating a hole 11 of a big ball 10, two end hooks 13 disposed on two ends of the elastic cable 12, and two small ball 15 having retainer rings 14 to receive one of the end hooks 13.

Figure 3:
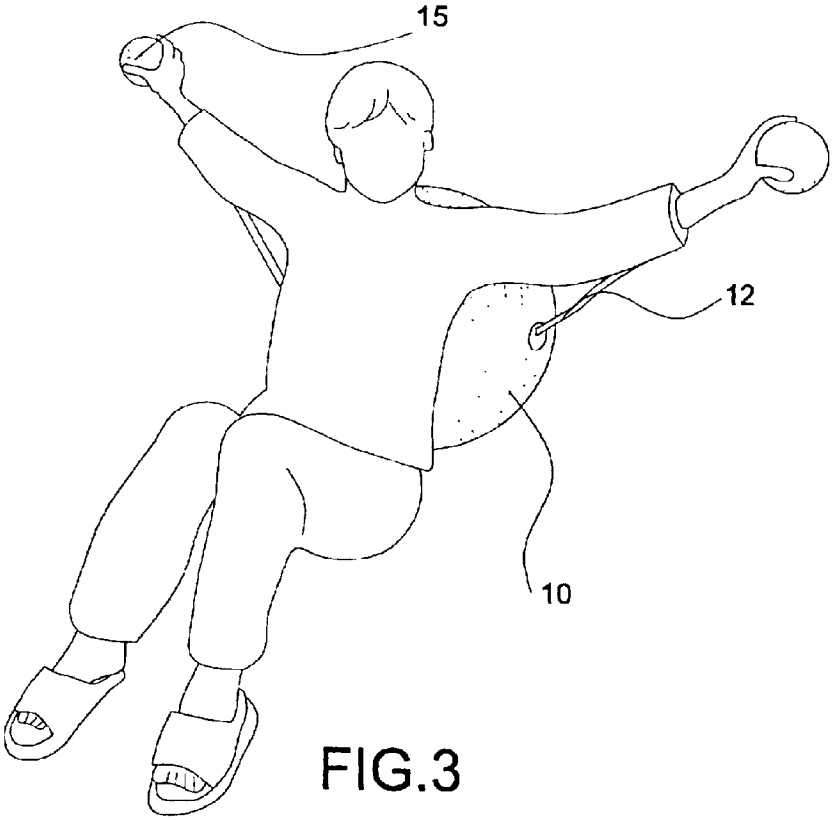
FIG. 3 is a schematic view illustrating a user holds two small balls then extends an elastic cable to front side or back side.

Referring to FIG. 3, a user holds two small balls 15 then extends an elastic cable 12 to front side or back side.

Figure 4:
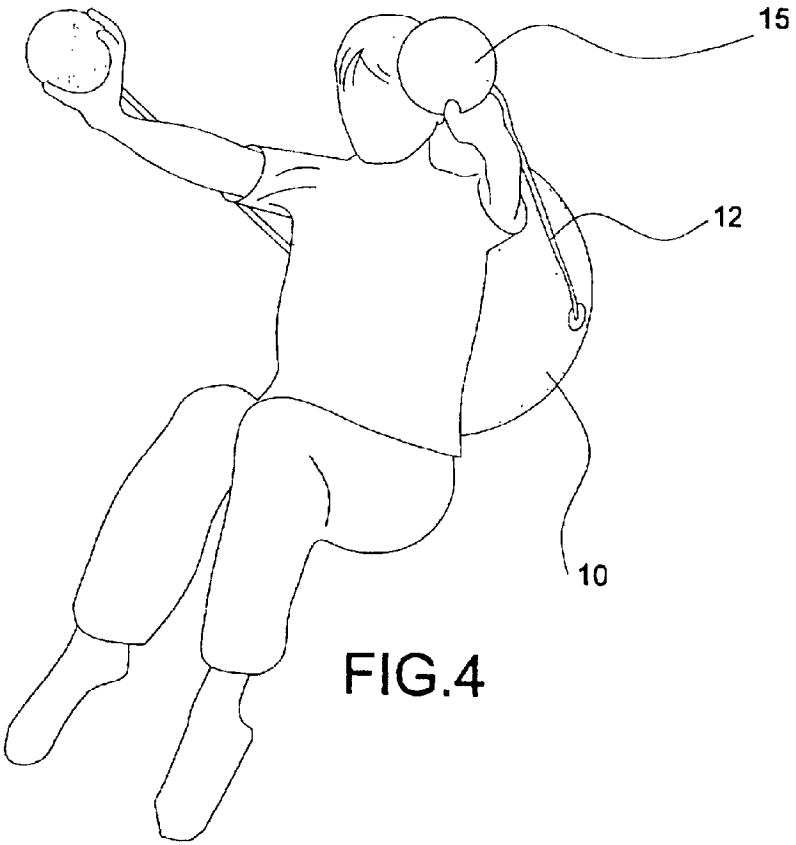
FIG. 4 is a schematic view illustrating a user holds two small balls then extends an elastic cable to left side or right side.

Referring to FIG. 4, a user holds two small balls 15 then extends an elastic cable 12 to left side or right side.

Figure 5:
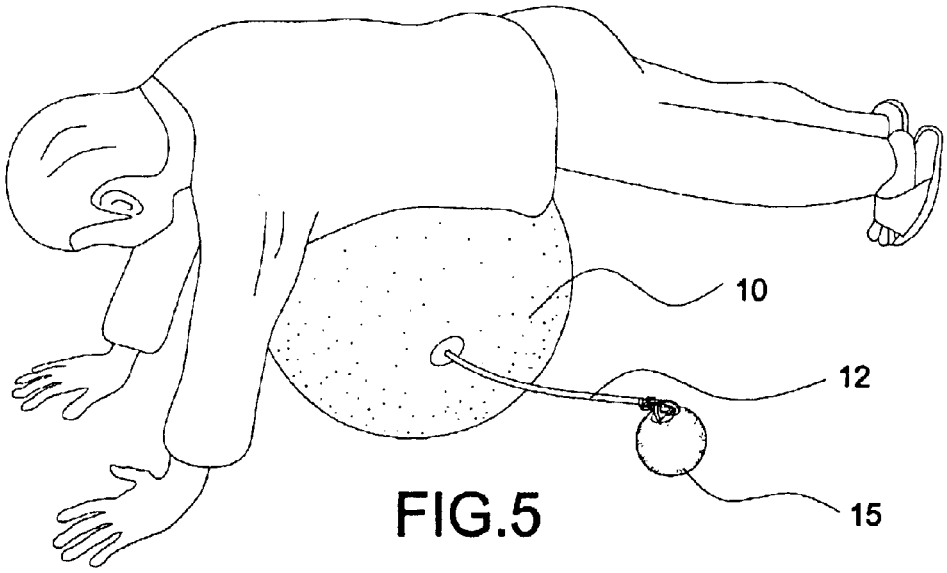
FIG. 5 is a schematic view illustrating a user prostrates himself/herself on a big ball.

Referring to FIG. 5, a user prostrates himself/herself on a big ball 10.

Figure 6:
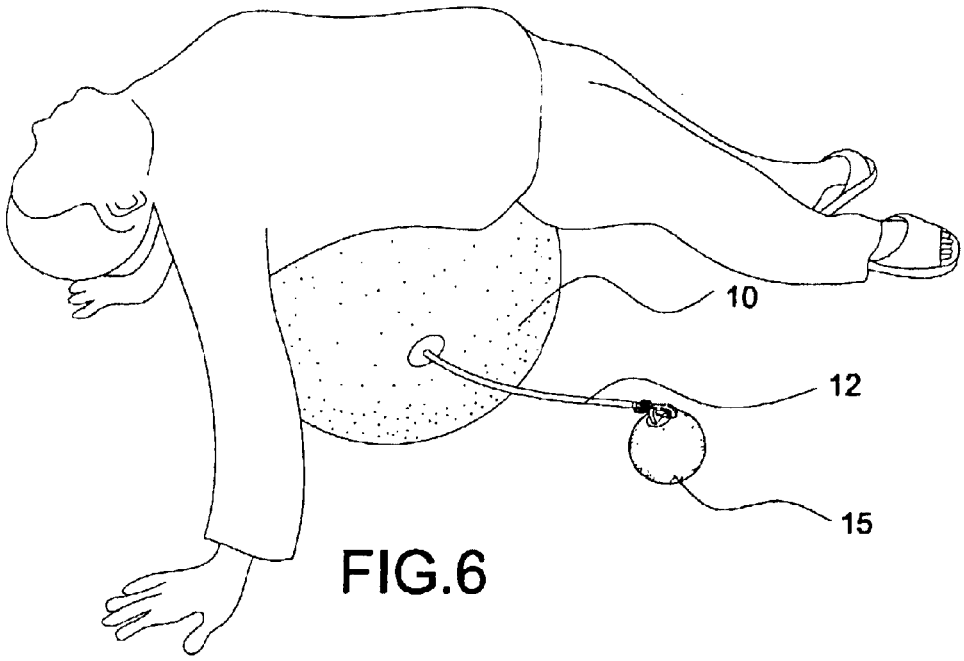
FIG. 6 is a schematic view illustrating a user lies down on a big ball.

Referring to FIG. 6, a user lies down on a big ball 10. The invention is not limited to the above embodiment but various modification thereof may be made. Further, various changes in form and detail may be made without departing from the scope of the invention.

What is claimed is:

1. An exercise ball device comprising:

a large ball for supporting a user's body, the ball having a hole through the center thereof;

an elastic cable extending through the hole, the elastic cable having two ends;

two end hooks, one end hook disposed on each respective end of the cable; and two small balls for grasping by the user, each small ball having a retainer ring to receive a respective end hook.

* * * * *